US009579910B2

(12) United States Patent
Mukaiyama

(10) Patent No.: US 9,579,910 B2
(45) Date of Patent: Feb. 28, 2017

(54) RECORDING APPARATUS AND INSPECTION METHOD

(71) Applicant: Seiko Epson Corporation, Tokyo (JP)

(72) Inventor: Kiyoshi Mukaiyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/994,284

(22) Filed: Jan. 13, 2016

(65) Prior Publication Data

US 2016/0214404 A1 Jul. 28, 2016

(30) Foreign Application Priority Data

Jan. 27, 2015 (JP) ..... 2015-013587

(51) Int. Cl.
*B41J 15/04* (2006.01)
*B65H 23/04* (2006.01)
*B65H 18/10* (2006.01)

(52) U.S. Cl.
CPC ..... *B41J 15/04* (2013.01); *B65H 18/103* (2013.01); *B65H 23/048* (2013.01); *B65H 2301/3422* (2013.01); *B65H 2404/511* (2013.01); *B65H 2801/36* (2013.01)

(58) Field of Classification Search
CPC ..... B41J 11/007; B41J 11/0095; B41J 15/04; B65H 23/048; B65H 18/103; B65H 2801/36; B65H 2301/3422; B65H 2404/511
See application file for complete search history.

(56) References Cited

U.S. PATENT DOCUMENTS

2011/0211008 A1* 9/2011 Teshigawara ..... B41J 3/60 347/16
2014/0307020 A1* 10/2014 Toriihara ..... B41J 11/663 347/16

FOREIGN PATENT DOCUMENTS

JP 2006-205358 A 8/2006
JP 2011-161783 A 8/2011

* cited by examiner

*Primary Examiner* — Justin Seo
*Assistant Examiner* — Roger W Pisha, II

(57) ABSTRACT

A recording apparatus includes a feeding section that feeds a rolled continuous paper into an apparatus body, a recording section disposed in the apparatus body, the recording section performing recording onto the continuous paper fed from the feeding section in the apparatus body, a first transport path along which the continuous paper is transported during the recording performed on the medium by the recording section, and a second transport path along which the continuous paper is transported to be rewound onto the feeding section. The second transport path is different from the first transport path.

12 Claims, 4 Drawing Sheets

RECORDING APPARATUS AND INSPECTION METHOD

BACKGROUND

1. Technical Field

The present invention relates recording apparatuses and inspection methods.

2. Related Art

As an example of recording apparatuses, ink jet printers that eject liquid such as ink from a recording section and print an image or the like on a medium, for example, continuous paper transported on a support section by a transport section are known. Some of such printers have a winding device that winds a transported medium, which is fed from a feeding section, and on which an image or the like is formed by a recording section, on the side opposite the feeding section (for example, see JP-A-2011-161783).

The user checks the medium, on which the image or the like has been formed by the recording section, to check whether the image or the like has been appropriately printed, that is, the user performs inspection of the medium. When the user performs inspection, the user attaches an end, which is a free end portion, of the transported medium onto a winding shaft of an inspection device dedicated to inspection, and while the transported medium is being wound around the winding shaft, the user visually checks the image printed on the transported medium.

The inspection of the transported medium requires the inspection device in addition to the printer, and the user has to set the transported medium to the inspection device. This operation before starting the inspection is troublesome.

SUMMARY

An advantage of some aspects of the invention is to provide a recording apparatus and an inspection method for readily starting the inspection of a transported medium.

Hereinafter, the apparatus and the method, and their operational advantages will be described. A recording apparatus according to an aspect includes a feeding section that feeds a long medium into an apparatus body, a recording section disposed in the apparatus body, the recording section performing recording onto the medium fed from the feeding section in the apparatus body, a first transport path along which the medium is transported during the recording performed on the medium by the recording section, and a second transport path along which the medium is transported to be rewound onto the feeding section. The second transport path is different from the first transport path.

While recording is being performed on the transported medium, the medium is transported via the first transport path that passes through the inside of the apparatus body, and thus, it is difficult for the user to visually check the medium. On the other hand, while the medium is being rewound to the feeding section, the medium is rewound via the second transport path that is different from the first transport path. On the second transport path, the transported medium is rewound through the outside of the apparatus body to the feeding section. This enables the user to visually check the portion on which the recording has been performed from the outside of the apparatus body. Accordingly, the user can inspect the transported medium while the medium is being rewound via the second transport path to the feeding section. This eliminates the operation of setting the transported medium to an inspection device different from the recording apparatus, and the user can readily start the inspection of the medium.

In the above-described recording apparatus, it is preferable that the medium be transported along the second transport path on a front surface side, which is the outside of the apparatus body, of the apparatus body to be rewound onto the feeding section.

With this structure, the transported medium passes through the front surface side of the apparatus body, and the user can readily see the portion on which the recording has been made in the transported medium. This enables the user to readily inspect the transported medium.

Preferably, the recording apparatus further includes a winding section that winds the medium discharged from a discharge opening formed in the apparatus body. The medium wound by the winding section is rewound onto the feeding section via the second transport path.

With this structure, the transported medium is wound by the winding section, and this suppresses or prevents the possibility of the transported medium on which the recording has been performed by the recording section being put, for example, on the floor. This reduces the possibility of the transported medium being smudged.

Preferably, the recording apparatus further includes an urging section provided in the middle of the second transport path, the urging section urging the medium from a surface opposite to the surface on which the recording has been performed by the recording section.

With this structure, the urging section urges the transported medium, and this reduces the slack in the medium. Accordingly, during the inspection, the user can readily see the portion on which the recording has been performed in the transported medium. This enables the user to readily inspect the transported medium.

Preferably, the recording apparatus further includes an operation section that performs operation associated with transport of the medium and based on the operation of the operation section, a transport speed of the medium on the second transport path can be changed.

With this structure, the transport speed of the transported medium can be changed depending on the position of the medium in the direction in which the medium is rewound to the feeding section. For example, the user can effectively inspect the transported medium by increasing the transport speed of the transported medium for a portion on which the inspection can be readily performed, for example, a portion printed with a solid color on the medium.

Preferably, the recording apparatus further includes an operation section that performs operation associated with transport of the medium, and motors provided at both sides of the medium in a direction intersecting a transport direction in which the medium is transported, the motors being driven to rewind the medium to the feeding section. Rotation speeds of the respective motors are separately controlled based on the operation of the operation section.

With this structure, for example, when the transported medium is rewound onto the feeding section in a state in which the medium is inclined, that is, when so-called skew occurs, the inclination of the transported medium can be reduced by controlling the rotation speed of each of the motors.

A method according to an aspect is a method of inspecting the medium on which the recording has been performed by the recording section in the above-described recording apparatus. The method includes transporting the medium on which the recording has been performed by the recording section to a downstream side of the recording section in the first transport path, attaching the free end portion of the medium at an upstream side to the feeding section via the second transport path, and rewinding the medium by the feeding section via the second transport path after the attaching of the medium.

With this method, the user can inspect the transported medium while the medium is being rewound onto the feeding section in the rewinding. This eliminates the operation of setting the transported medium to an inspection device different from the recording apparatus, and the user can readily start the inspection of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a recording apparatus will be described with reference to the attached drawings. The recording apparatus according to the embodiment is, for example, an ink jet printer that performs recording (printing) by ejecting ink, which is an example of liquid, onto a transported medium. The printer is a so-called serial-type printer that moves a recording section in a width direction which is a direction intersecting a transport direction of the medium.

Figure 1:
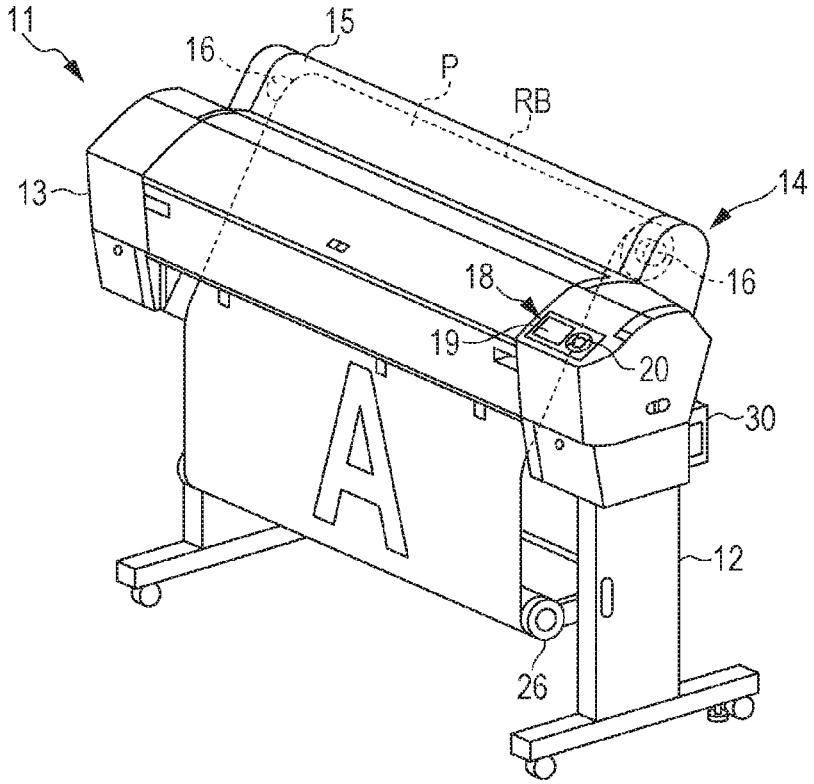
FIG. 1 is a perspective view of a recording apparatus according to an embodiment.

As illustrated in FIG. 1, a recording apparatus 11 includes an apparatus body 13 having a shape of a substantially rectangular parallelepiped and being supported by a leg stand 12, and a feeding section 14 projecting from a rear surface section of the apparatus body 13 in an upper rear slanting direction. In the description below, a "front/rear direction", a "right/left direction", and a "up/down direction" are directions in viewing the recording apparatus 11 that is long in the right/left direction from the front surface side of the apparatus body 13 in FIG. 1.

Figure 2:
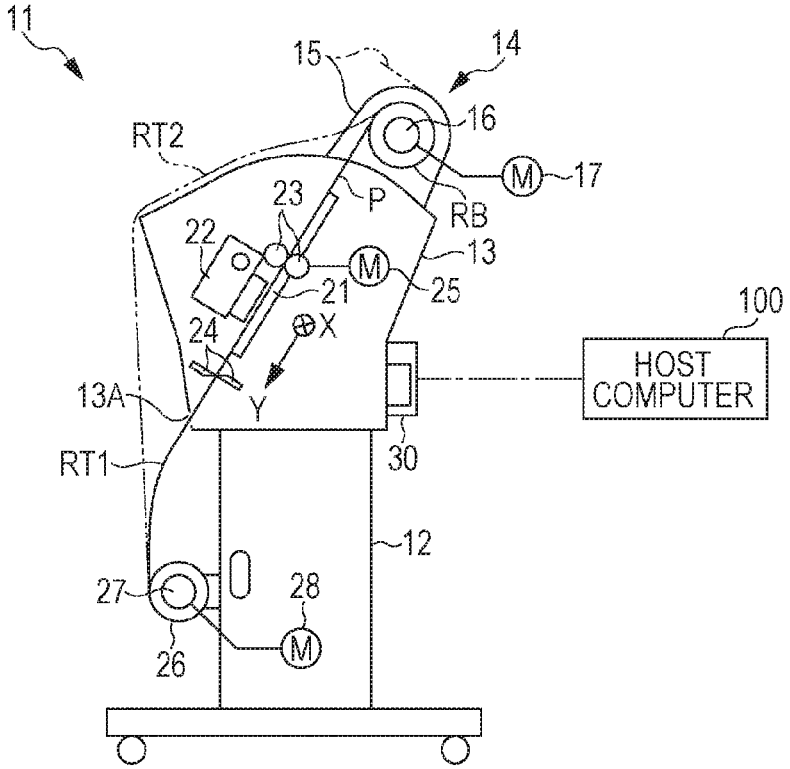
FIG. 2 schematically illustrates an internal structure of the recording apparatus in FIG. 1.

The feeding section 14 includes a flip-up opening/closing cover 15. In the feeding section 14, in a state the opening/closing cover 15 is open, a roll body RB is loaded. The roll body RB is formed by rolling up long continuous paper P which is an example of the medium to be transported. The roll body RB is supported by a pair of roll body supporting sections 16 provided at positions corresponding to both ends of the roll body RB in a longitudinal direction in the feeding section 14. The roll body supporting sections 16 are connected to, with a speed reducer (not shown) interposed therebetween, and driven by a feeding motor 17 (see FIG. 2) for rotating the roll body RB. The feeding section 14 feeds the continuous paper P into the apparatus body 13 by using the feeding motor 17. In FIG. 2, the feeding motor 17 is disposed outside the feeding section 14, however, actually, the feeding motor 17 is accommodated in the feeding section 14.

An operation section 18 that is used by users to operate the recording apparatus 11 is provided at the right front side of the apparatus body 13. The operation section 18 includes a display section 19, which is a liquid crystal panel for displaying operation contents, and an operation button 20 for changing or selecting the operation content.

As illustrated in FIG. 2, the apparatus body 13 accommodates a supporting section 21, a recording section 22, a transport roller pair 23, a cutting section 24, and a transport motor 25. The supporting section 21 supports the continuous paper P, which is fed by the feeding section 14 and transported while being pinched by the transport roller pair 23, from the rear surface side of the continuous paper P. The recording section 22 includes a liquid ejecting head that ejects ink onto the continuous paper P to form an image in a recording area being set on the supporting section 21. The cutting section 24 cuts the continuous paper P, on which an image has been recorded (printed) by the recording section 22, in a width direction X (a direction perpendicular to the plane of FIG. 2) of the continuous paper P intersecting a transport direction Y. The transport motor 25 is connected, with a speed reducer (not shown) interposed therebetween, to the drive roller of the transport roller pair 23 so as to drive the drive roller.

On the leg stand 12, a winding section 26 that winds the continuous paper P discharged from a discharge opening 13A in the front surface of the apparatus body 13 is provided. The winding section 26 includes a winding shaft 27 extending in the width direction X. The winding shaft 27 is connected, with a speed reducer (not shown) interposed therebetween, to a winding motor 28 that drives and rotates the winding shaft 27 to take up the continuous paper P.

The recording apparatus 11 includes a control device 30 that controls the feeding motor 17, the recording section 22, the transport motor 25, the cutting section 24, and the winding motor 28. Print data and commands that are instructions for executing various kinds of processing are sent from a host computer 100 to the control device 30 by wireless or wired communication. The control device 30 controls the feeding motor 17, the recording section 22, the transport motor 25, the cutting section 24, and the winding motor 28 in accordance with the data and commands sent from the host computer 100.

The control device 30 has control modes, that is, a print mode for performing printing on the continuous paper P, and an inspection mode for a user to perform inspection of the continuous paper P. The print mode and the inspection mode are switched, for example, in accordance with an operation of the operation section 18 (see FIG. 1).

In the print mode, the control device 30 controls the feeding motor 17, the transport motor 25, and the winding motor 28 to rotate in the forward direction to transport the continuous paper P to a recording area, and controls the recording section 22 to eject ink onto the continuous paper P so that the paper transport and the ink ejection are alternately performed to form an image or the like, the data of which is received from the host computer 100, onto the continuous paper P. The continuous paper P discharged from the discharge opening 13A of the apparatus body 13 is wound onto the winding shaft 27.

In the inspection mode, the control device 30 controls the winding motor 28 and the feeding motor 17 to rotate in the reverse direction in a state in which the continuous paper P wound onto the winding shaft 27 is attached to the feeding section 14 so that the continuous paper P wound on the winding shaft 27 is wound by the feeding section 14. In the inspection mode, the transport motor 25 is stopped.

Figure 3:
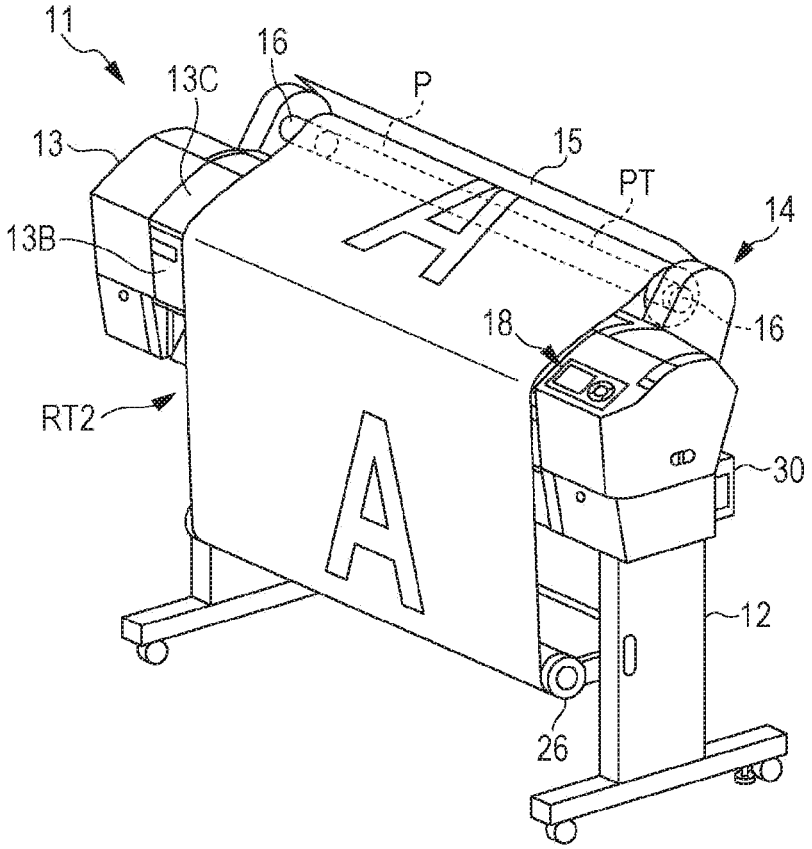
FIG. 3 is a perspective view of the recording apparatus in an inspection of a transported medium.
Figure 4:
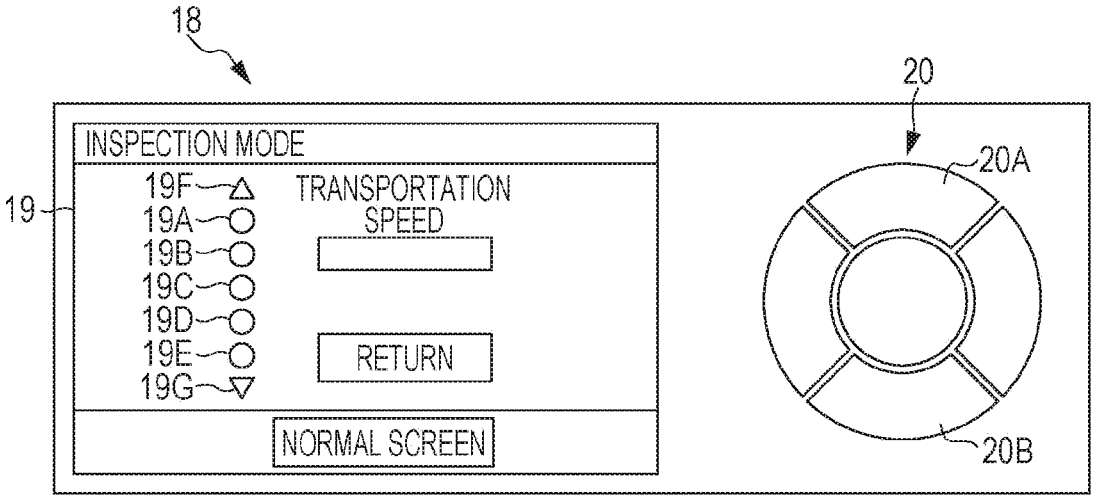
FIG. 4 is a plan view schematically illustrating an operation section of the recording apparatus.

With reference to FIGS. 2 to 4, a method of inspecting the continuous paper P is described. This inspection method includes a winding process of winding the continuous paper P, on which recording has been performed by the recording section 22, by the winding shaft 27, a continuous paper attaching process, which is a medium attaching process of attaching the continuous paper P wound onto the winding shaft 27 to the feeding section 14, and a rewinding process of rewinding the continuous paper P wound by the winding shaft 27 to the feeding section 14. The winding process corresponds to a transport process of transporting the continuous paper P, on which recording has been performed by the recording section 22, to the downstream side of the recording section 22 in a first transport path RT1.

In the winding process, after the completion of the recording by the recording section 22 onto the continuous paper P in accordance with a print command, the cutting section 24 cuts the continuous paper P in the width direction X. All the cut continuous paper P is wound onto the winding shaft 27 by the winding motor 28. Alternatively, all the continuous paper P, which has been completely fed and an upstream side end portion of the continuous paper P is detached from the feeding section 14, is wound onto the winding shaft 27.

Then, in the continuous paper attaching process, the opening/closing cover 15 of the feeding section 14 is opened, and the roll body RB (in a case where all of the continuous paper P of the roll body RB is fed, the paper tube) supported by the roll body supporting sections 16 of the feeding section 14 is removed. In place of the removed roll body RB, a new paper tube PT (see FIG. 3) for winding the continuous paper P is attached to the roll body supporting sections 16. Then, an end, which is a free end portion, of the continuous paper P wound onto the winding shaft 27 is fed from the winding shaft 27, and the end is attached onto the paper tube PT, for example, with a tape (not shown). As illustrated by the chain double-dashed line in FIG. 2 and FIG. 3, the continuous paper P fed from the winding shaft 27 passes along the front surface 13B and the upper surface 13C, which are outside the apparatus body 13, and the continuous paper P is attached onto the paper tube PT.

As described above, the first transport path RT1 that is the transport path of the continuous paper P used in printing, and the second transport path RT2 that is the transport path of the continuous paper P used in inspection are different from each other. In this structure, after the completion of the printing, the winding shaft 27 is not removed from the recording device 11, and the end of the continuous paper P is fed from the winding shaft 27, and thus, the surface of the continuous paper P on which the image has been printed is the front surface side. The continuous paper P transported via the second transport path RT2 passes along the front surface 13B and the upper surface 13C of the apparatus body 13, that is, the continuous paper P passes on the path at the position higher than the discharge opening 13A. Further, the continuous paper P does not move in the width direction X, and therefore does not cover the operation section 18. In addition, as illustrated by the chain double-dashed line in FIG. 2, the second transport path RT2 does not include the roller pair for pinching the continuous paper P and the roller that comes in contact with the surface of the continuous paper P on which the image has been printed. During the inspection of the continuous paper P, the opening/closing cover 15 remains open.

In the rewinding process, when the print mode is changed to the inspection mode by an operation of the operation section 18, the winding motor 28 and the feeding motor 17 reversely rotate to wind, onto the paper tube PT, the continuous paper P wound onto the winding shaft 27. During the inspection, the user stands in front of the recording apparatus 11, and visually checks the image or the like on the continuous paper P being rewound.

As illustrated in FIG. 4, when the control device 30 is in the inspection mode, a normal screen in the print mode is changed to an operation screen dedicated to the inspection mode on the display section 19 in the operation section 18 in response to an operation of the operation section 18. Specifically, the normal screen is switched to the operation screen for operating the display of the transport speed that is a speed for rewinding the continuous paper P from the winding section 26 to the feeding section 14, and the change of the transport speed. That is, when the control device 30 is in the inspection mode, the transport speed of the continuous paper P can be changed through an operation of the operation section 18. The operation button 20, for example, is used to change the transport speed of the continuous paper P. More specifically, pressing a button 20A in the operation button 20 increases the transport speed of the continuous paper P, and pressing a button 20B in the operation button 20 decreases the transport speed of the continuous paper P.

On the display section 19, among five round signs 19A to 19E, the center round sign 19C indicates a state in which the transport of the continuous paper P is stopped. In the round signs 19A and 19B displayed at the upper side of the round sign 19C, the round sign 19B indicates a normal speed of the transport speed, and the round sign 19A indicates a maximum speed. In the round signs 19D and 19E displayed at the lower side of the round sign 19C, the round sign 19D indicates a normal speed in transporting the continuous paper P in the direction opposite to the direction of the round sign 19B, and the round sign 19E indicates a maximum speed. The indication of the round sign 19C is changed, for example, to black when the transport of the continuous paper P is stopped. When the button 20A is pressed once, the indication of the round sign 19C is returned to the original color, and the indication of the round sign 19B is changed. When the button 20B is pressed once in a state in which the transport of the continuous paper P is stopped, the indication of the round sign 19C is returned to the original indication, and the indication of the round sign 19D is changed. Alternatively, a stop button may be pressed to change the indication of the round sign 19C and stop the transport of the continuous paper P.

In a case where the display section 19 is a touch panel, in order to change the transport speed of the continuous paper P, one of the two triangular signs 19F and 19G of the display section 19 may be pressed in addition to pressing the operation button 20. The triangular sign 19F is arranged at the upper side of the round signs 19A to 19E, and used to increase the transport speed of the continuous paper P. The triangular sign 19G is arranged at the lower side of the round signs 19A to 19E, and used to decrease the transport speed of the continuous paper P. Alternatively, an operation by a user in an upward direction on the touch panel may increase the transport speed of the continuous paper P, and an operation by a user in a downward direction may decrease the transport speed of the continuous paper P. Alternatively, a transport speed of the continuous paper P may be determined in accordance with an amount of flick (slide) operation or an accumulated amount of operation amounts.

The recording apparatus 11 according to the embodiment achieves the following operational advantages.

(1) The end of the continuous paper P wound onto the winding shaft 27 is attached to the paper tube PT of the feeding section 14 via the second transport path RT2, which is different from the first transport path RT1 used in the printing on the continuous paper P. The user inspects the continuous paper P while the continuous paper P wound onto the winding shaft 27 is being rewound onto the paper tube PT. The user can visually check the continuous paper P on the second transport path RT2, which passes through the outside of the apparatus body 13 and is used to rewind the continuous paper P onto the paper tube PT of the feeding section 14 from the winding shaft 27. This enables the user to readily inspect the continuous paper P, and eliminates the operation of setting the continuous paper P wound onto the winding shaft 27 to an inspection device that is different from the recording apparatus 11. Accordingly, the user can readily start the inspection of the continuous paper P.

The first transport path RT1 is not used to rewind the continuous paper P to the paper tube PT, and this prevents the continuous paper P from being pinched by the transport roller pair 23. Accordingly, possibilities of damaging the image or the like on the continuous paper P by the transport roller pair 23 can be reduced.

(2) The continuous paper P is transported on the second transport path RT2 and passes through the front surface 13B side of the apparatus body 13. This enables the user to readily see the continuous paper P from the front side of the recording apparatus 11, and to readily inspect the continuous paper P.

(3) The continuous paper P, on which the printing has been made by the recording section 22, is wound by the winding shaft 27, and this suppresses or prevents the possibility of the continuous paper P being put, for example, on a floor. This suppresses or prevents the continuous paper P being smudged.

(4) When the control device 30 is in the inspection mode, the user can change the transport speed of the continuous paper P from the winding shaft 27 to the paper tube PT by operating the operation section 18. This enables the user to effectively inspect the continuous paper P by increasing the transport speed for a portion where no image has been formed or a portion printed with a solid color on the continuous paper P.

(5) The continuous paper P passes through the position higher than the discharge opening 13A of the apparatus body 13 in the second transport path RT2. This increases the area of the continuous paper P being exposed to the outside of the apparatus body 13 as compared to the case where the continuous paper P passes through the first transport path RT1. Accordingly, in the inspection, the user can readily see the continuous paper P.

Figure 5:
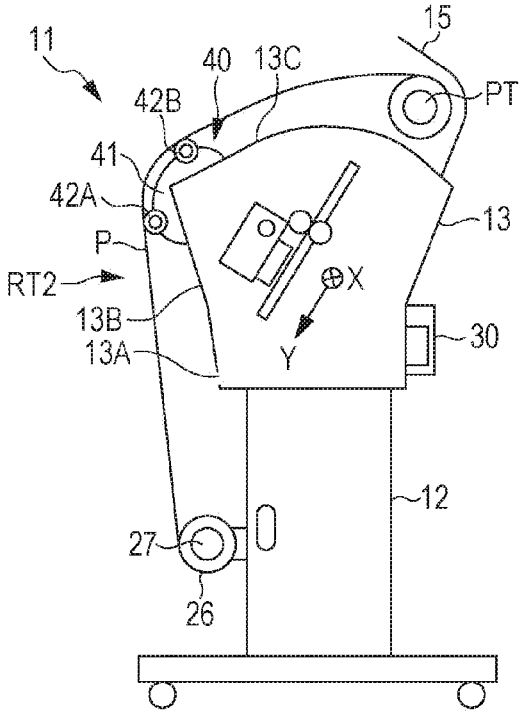
FIG. 5 is a side view schematically illustrating a recording apparatus according to a modification.

The embodiment can be modified to modifications described below. In FIGS. 5 to 7, the roll body supporting sections 16 are not illustrated. In the above-described embodiment, as illustrated in FIG. 5, the recording apparatus 11 may include a transport support section 40 that supports the continuous paper P at a corner between the front surface 13B and the upper surface 13C of the apparatus body 13. The transport support section 40 can be detachable from the apparatus body 13. The transport support section 40 includes a support body section 41 that extends in the width direction X and can be attached to the apparatus body 13. At an upper side and a lower side of the support body section 41, a pair of rollers 42A and 42B extending in the width direction X is provided. The pair of the rollers 42A and 42B is rotatably attached to the support body section 41.

In the recording apparatus 11 illustrated in FIG. 5, the pair of the rollers 42A and 42B rotates with transport of the continuous paper P while the continuous paper P wound onto the winding shaft 27 is being wound onto the paper tube PT. This achieves smooth transport of the continuous paper P from the winding shaft 27 to the paper tube PT.

Figure 6A:
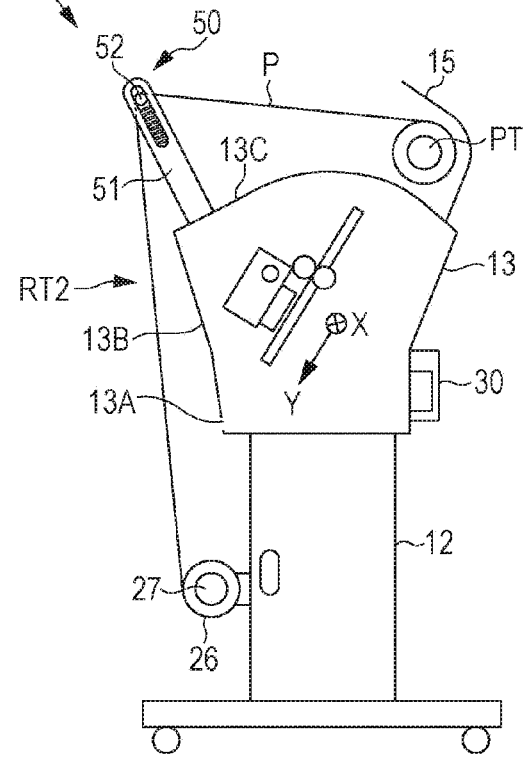
FIG. 6A is a side view schematically illustrating a recording apparatus according to another modification.
Figure 6B:
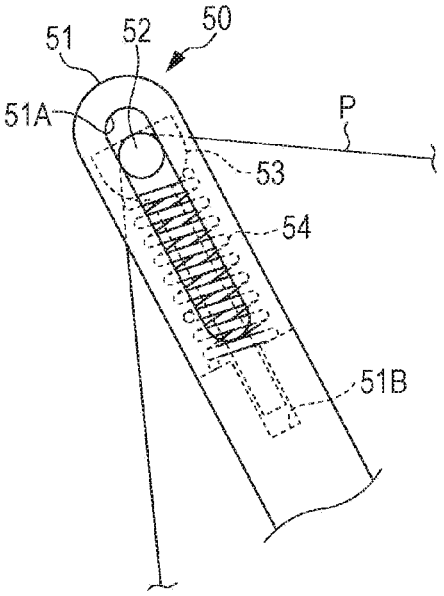
FIG. 6B is an enlarged view illustrating an urging section in the recording apparatus illustrated in FIG. 6A.
Figure 7:
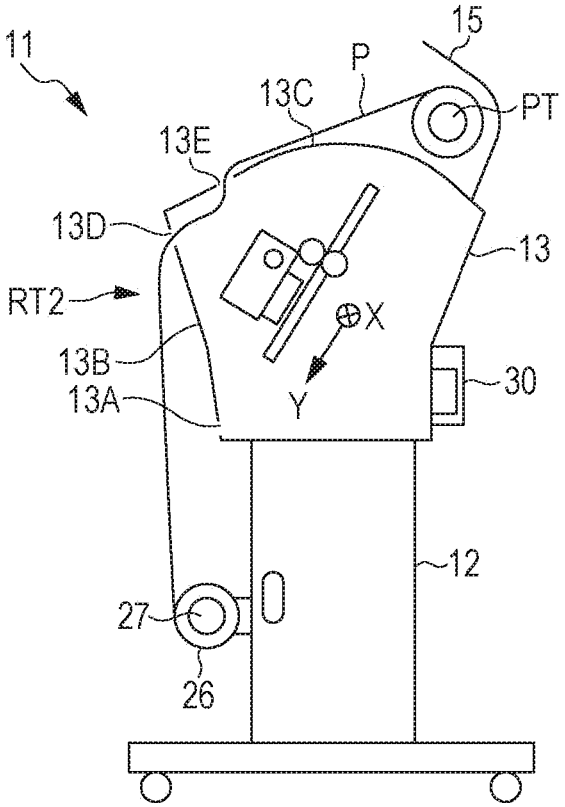
FIG. 7 is a side view schematically illustrating a recording apparatus according to yet another modification.

In the above-described embodiment, as illustrated in FIG. 6A, the recording apparatus 11 may include an urging section 50 that urges the continuous paper P from the side (rear side) opposite to the side on which an image or the like has been printed. The urging section 50 can be detachable from the apparatus body 13. The urging section 50 includes a pair of arms 51 attached to the both ends of the apparatus body 13 in the width direction X, and a roller 52 attached between the pair of arms 51. The pair of arms 51 is positioned outside as compared to the continuous paper P in the width direction X. As illustrated in FIG. 6B, the roller 52 is inserted into long holes 52 that extend in the longitudinal direction of the arms 51, and are formed as through holes in the width direction X. To each of the arms 51, a roller support section 53 which supports the roller 52 in a rotatable state and a coil spring 54 which serves as an urging member that urges upwardly the roller support section 53 are attached. The end portion of the roller support section 53 on the opposite side of the roller 52 is inserted into a supporting hole 51B formed in each of the arms 51. As illustrated in 6A, it is preferable that the roller 52 is provided at a position higher than the position of the paper tube PT.

In the recording apparatus 11 illustrated in FIGS. 6A and 6B, the continuous paper P is upwardly urged by the urging section 50. This suppresses occurrence of slack in the continuous paper P between the winding section 26 and the urging section 50. Accordingly, the user can readily inspect the continuous paper P from the front side of the recording apparatus 11. Further, the roller 52 of the urging section 50 rotates with the transport of the continuous paper P, and thus the continuous paper P can be smoothly transported from the winding shaft 27 to the paper tube PT.

In the above-described embodiment, as long as the second transport path RT2 is different from the first transport path RT1, the second transport path RT2 may be a path that passes inside the apparatus body 13 through which the continuous paper P is transported. For example, as illustrated in FIG. 7, the continuous paper P may be transported to the inside of the apparatus body 13 via a front surface opening 13D in the front surface 13B of the apparatus body 13, and then to the outside of the apparatus body 13 via an upper surface opening 13E in the upper surface 13C of the apparatus body 13. Preferably, the front surface opening 13D is provided at a position higher than the position of the discharge opening 13A in the apparatus body 13.

In the above-described embodiment, the winding section 26 can be omitted from the recording apparatus 11. That is, the recording apparatus 11 may be designed such that, after the continuous paper P is fed from the feeding section 14 and recording is performed by the recording section 22, the continuous paper P cut by the cutting section 24 is temporarily put, for example, on a floor, and then, the end of the continuous paper P may be attached to the paper tube PT of the feeding section 14 at the time of inspection.

In the above-described embodiment, the winding section 26 may include two winding shafts 27 that are aligned in the width direction X to wind the both ends of the continuous paper P in the width direction X, and winding motors 28 that are provided to the winding shafts 27 to be drive sources for winding both ends of the continuous paper P in the width direction X respectively. In such a case, each of the winding motors 28 may be controlled separately in accordance with an operation of the operating unit 18. With this structure, for example, when the continuous paper P wound onto the winding shaft 27 is rewound onto the paper tube PT in a state in which the continuous paper P is inclined with respect to the width direction X, that is, when so-called skew occurs, the inclination of the continuous paper P with respect to the width direction X can be reduced by controlling the rotation speed of each of the winding motors 28.

The feeding section 14 may have a structure similar to that of the winding section 26, that is, the feeding motor 17 may be provided to each of the roll body supporting sections 16 to wind each end of the continuous paper P. In such a case, the paper tube PT is attached to each of the roll body supporting sections 16 so that the both ends of the continuous paper P in the width direction X are wound. The size of the paper tube PT in the width direction X is less than or equal to half the size of the paper tube PT according to the above embodiment in the width direction X.

In the above-described embodiment, in the inspection mode, the transport speed of the continuous paper P can be adjusted in the five levels with the five round signs 19A to 19E on the display section 19. Alternatively, the transport speed of the continuous paper P may be adjusted in two to four levels, or in six or more levels. Alternatively, the transport speed of the continuous paper P may be continuously varied.

In the above-described embodiment, the tension of the continuous paper P may be adjusted by adjusting the rotation speeds of the winding motor 28 and the feeding motor 17. The feeding section 14 may further include a tension adjustment device (not shown) that adjusts the tension of the continuous paper P. In such a case, when the continuous paper P wound onto the winding shaft 27 is wound onto the paper tube PT, the continuous paper P is attached to pass through the tension adjustment device. With this structure, when the continuous paper P wound onto the winding shaft 27 is rewound onto the paper tube PT, the tension adjustment device can reduce the slack in the continuous paper P. Accordingly, the user can readily see the continuous paper P.

In the above-described embodiment, the recording apparatus 11 may be a dot impact printer or a laser printer as long as the printer can perform printing onto a transported medium. The recording apparatus 11 is not limited to the apparatus having only the print function, and the recording apparatus 11 may be a multifunction peripheral. Further, the recording apparatus 11 is not limited to the serial printer, and the recording apparatus 11 may be a line printer or a page printer.

The medium to be transported is not limited to the continuous paper P, and the medium may be single sheets of paper, a resin film, metallic foil, a metallic film, a composite film (laminate film) of resin and metal, fabric, nonwoven fabric, or a ceramic sheet.

The state of the fine droplets of the liquid ejected from the recording section 22 may be granular, teardrop shape, or stringy. The liquid may be any material that can be ejected from the recording section 22. For example, any material in a liquid phase may be used, including liquids having high or low viscosity, and fluid materials such as sol, gel, other inorganic solvents, organic solvents, solutions, and liquid resin. Further, the liquid is not limited to liquid as one state of a material but includes a liquid in which particles of a solid material such as a pigment are dissolved, dispersed, or mixed in a solvent. In a case where the liquid is ink, the ink includes general water-based ink, oil-based ink, as well as various liquid compositions such as gel ink, hot melt ink and the like.

The entire disclosure of Japanese Patent Application No. 2015-013587, filed Jan. 27, 2015 is expressly incorporated by reference herein.

What is claimed is:

1. A recording apparatus comprising:

a feeding section that feeds a long medium into an apparatus body;

a recording section disposed in the apparatus body, the recording section performing recording onto the medium fed from the feeding section in the apparatus body;

a first transport path along which the medium is transported during the recording performed on the medium by the recording section; and a second transport path along which the medium is transported to be rewound onto the feeding section, wherein the second transport path is outside of the apparatus body and different from the first transport path.

2. The recording apparatus according to claim 1, wherein the medium is transported along the second transport path on a front surface side of the apparatus body to be rewound onto the feeding section.

3. The recording apparatus according to claim 1, further comprising:

an urging section provided in a middle of the second transport path, the urging section urging the medium from a surface opposite to the surface on which the recording has been performed by the recording section.

4. A method of inspecting the medium on which the recording has been performed by the recording section in the recording apparatus according to claim 1, the method comprising:

transporting the medium on which the recording has been performed by the recording section to a downstream side of the recording section in the first transport path;

attaching a free end portion of the medium at an upstream side to the feeding section via the second transport path; and rewinding the medium by the feeding section via the second transport path after the attaching of the medium.

5. A method of inspecting the medium on which the recording has been performed by the recording section in the recording apparatus according to claim 2, the method comprising:

transporting the medium on which the recording has been performed by the recording section to a downstream side of the recording section in the first transport path;

attaching a free end portion of the medium at an upstream side to the feeding section via the second transport path; and rewinding the medium by the feeding section via the second transport path after the attaching of the medium.

6. A method of inspecting the medium on which the recording has been performed by the recording section in the recording apparatus according to claim 3, the method comprising:

transporting the medium on which the recording has been performed by the recording section to a downstream side of the recording section in the first transport path;

attaching a free end portion of the medium at an upstream side to the feeding section via the second transport path; and rewinding the medium by the feeding section via the second transport path after the attaching of the medium.

7. A recording apparatus comprising:

a feeding section that feeds a long medium into an apparatus body;

a recording section disposed in the apparatus body, the recording section performing recording onto the medium fed from the feeding section in the apparatus body;

a first transport path along which the medium is transported during the recording performed on the medium by the recording section;

a second transport path along which the medium is transported to be rewound onto the feeding section; and a winding section that winds up the medium discharged from a discharge opening formed in the apparatus body, wherein the second transport path is different from the first transport path, and wherein the medium wound by the winding section is rewound onto the feeding section via the second transport path.

8. A method of inspecting the medium on which the recording has been performed by the recording section in the recording apparatus according to claim 7, the method comprising:

transporting the medium on which the recording has been performed by the recording section to a downstream side of the recording section in the first transport path;

attaching a free end portion of the medium at an upstream side to the feeding section via the second transport path; and rewinding the medium by the feeding section via the second transport path after the attaching of the medium.

9. A recording apparatus comprising:

a feeding section that feeds a long medium into an apparatus body;

a recording section disposed in the apparatus body, the recording section performing recording onto the medium fed from the feeding section in the apparatus body;

a first transport path along which the medium is transported during the recording performed on the medium by the recording section;

a second transport path along which the medium is transported to be rewound onto the feeding section; and an operation section that performs operation associated with transport of the medium, wherein the second transport path is different from the first transport path, and wherein, based on the operation of the operation section, a transport speed of the medium on the second transport path can be changed.

10. A method of inspecting the medium on which the recording has been performed by the recording section in the recording apparatus according to claim 9, the method comprising:

transporting the medium on which the recording has been performed by the recording section to a downstream side of the recording section in the first transport path;

attaching a free end portion of the medium at an upstream side to the feeding section via the second transport path; and rewinding the medium by the feeding section via the second transport path after the attaching of the medium.

11. A recording apparatus comprising:

a feeding section that feeds a long medium into an apparatus body;

a recording section disposed in the apparatus body, the recording section performing recording onto the medium fed from the feeding section in the apparatus body;

a first transport path along which the medium is transported during the recording performed on the medium by the recording section;

a second transport path along which the medium is transported to be rewound onto the feeding section;

an operation section that performs operation associated with transport of the medium; and motors provided at both sides of the medium in a direction intersecting a transport direction in which the medium is transported, the motors being driven to rewind the medium to the feeding section, wherein the second transport path is different from the first transport path, and wherein rotation speeds of the respective motors are separately controlled based on the operation of the operation section.

12. A method of inspecting the medium on which the recording has been performed by the recording section in the recording apparatus according to claim 11, the method comprising:

transporting the medium on which the recording has been performed by the recording section to a downstream side of the recording section in the first transport path;

attaching a free end portion of the medium at an upstream side to the feeding section via the second transport path; and rewinding the medium by the feeding section via the second transport path after the attaching of the medium.

* * * * *